US006179677B1

(12) United States Patent
Dornier

(10) Patent No.: US 6,179,677 B1
(45) Date of Patent: Jan. 30, 2001

(54) WATER SPORT BELT

(76) Inventor: Gary P. Dornier, 3647 Elmwood La., Paulina, LA (US) 70763

( * ) Notice: Under 35 U.S.C. 154(b), the term of this patent shall be extended for 0 days.

(21) Appl. No.: 09/527,340

(22) Filed: Mar. 17, 2000

(51) Int. Cl.[7] ..... B63C 9/08
(52) U.S. Cl. ..... 441/113; 441/108
(58) Field of Search ..... 441/106, 108, 441/113, 117, 118, 125

(56) References Cited

U.S. PATENT DOCUMENTS

| | | | | |
|---|---|---|---|---|
| 1,856,632 | * | 5/1932 | Haines | 441/113 |
| 2,800,666 | * | 7/1957 | Allenbach | 441/113 |
| 4,176,772 | * | 12/1979 | Danon | 441/113 |
| 4,626,221 | | 12/1986 | Rocco | 441/108 |
| 5,180,321 | | 1/1993 | Brown | 441/94 |
| 5,348,504 | | 9/1994 | Pierce et al. | 441/113 |
| 5,368,512 | * | 11/1994 | Brown | 441/113 |
| 5,456,623 | | 10/1995 | Norris | 441/92 |
| 5,466,179 | | 11/1995 | Jeffrey, Sr. | 441/108 |
| 5,813,891 | | 9/1998 | McNamee | 441/108 |

* cited by examiner

*Primary Examiner*—Stephen Avila
(74) *Attorney, Agent, or Firm*—Joseph N. Breaux

(57) ABSTRACT

A water sport belt that includes an inflatable bladder that is be secured around the waist of a user to provide a flotation mechanism in an emergency. The inflatable bladder has a number of accordion fold sections that are inflated with an initial amount of air sufficient to provide buoyancy without the need for the user to blow with sufficient force to overcome the elastic walls of the bladder. The water sport belt also includes a water-tight compartment within which a user may safely position items to be kept safe and dry. A card holding structure is provided within the water-tight compartment to prevent damage to credit cards and the like by items such as coins and keys.

1 Claim, 4 Drawing Sheets

WATER SPORT BELT

TECHNICAL FIELD

The present invention relates to water sport accessories and more particularly to a water sport belt that includes an accordion fold resilient bladder member, a snap-open bladder cover assembly, and a two-part fastener assembly; the two-part fastener assembly including a first fastener portion secured to a first bladder end and a first cover assembly end and a second fastener portion secured to a second bladder end and a second cover assembly end; the accordion fold resilient bladder member being constructed from a resilient air impermeable material to have a number of accordion folds to allow for easy inflation through a flexible inflation tube having a one-way air inlet valve provided therein such that air blown into the accordion fold resilient bladder member through the flexible inflation tube is trapped therein; the snap-open bladder cover assembly having a cover member back side secured to a bladder member backside of the accordion fold resilient bladder member and a forward portion securable over the accordion fold resilient bladder member with a number of securing assemblies; the snap-open bladder cover assembly including a water-tight sealable pocket having a rigid, open-topped card holding structure provided therein for holding credit cards, driver's licenses, etc, an attachment loop for attaching water proof pagers, telephones, etc., a sealable pocket having a fastener securable closing flap, and a faster securable inflation tube access flap provided therethrough that includes a grasping tab extending from a side edge thereof.

BACKGROUND ART

People engaging in activities in and around the water often need a place to safely store items from theft and water damage. In addition, people engaged in activities in and around the water have a higher risk of injuries such as drowning. It would be a benefit, therefore, to have a water sport belt that included an inflatable bladder that could be secured around the waist of a user to provide a flotation mechanism in an emergency. Because it may be difficult for a person to inflate a resilient bladder such as a balloon while thrashing around in the water, it would be a benefit to have a water sport belt that included an inflatable bladder had a number of accordion fold sections that could be inflated with an initial amount of air sufficient to provide buoyancy without the need for the user to blow with sufficient force to overcome the elastic walls of the bladder. It would of course be a further benefit if the water sport belt included a water-tight compartment within which a user could safely position items to be kept safe and dry. Because credit cards, driver's licenses and the like can be damaged by items with sharp edges such as coins, keys and the like, it would be a further benefit if the water-tight compartment included a card holding structure therein for preventing such damage.

GENERAL SUMMARY DISCUSSION OF INVENTION

It is thus an object of the invention to provide a water sport belt that includes an accordion fold resilient bladder member, a snap-open bladder cover assembly, and a two-part fastener assembly; the two-part fastener assembly including a first fastener portion secured to a first bladder end and a first cover assembly end and a second fastener portion secured to a second bladder end and a second cover assembly end; the accordion fold resilient bladder member being constructed from a resilient air impermeable material to have a number of accordion folds to allow for easy inflation through a flexible inflation tube having a one-way air inlet valve provided therein such that air blown into the accordion fold resilient bladder member through the flexible inflation tube is trapped therein; the snap-open bladder cover assembly having a cover member back side secured to a bladder member backside of the accordion fold resilient bladder member and a forward portion securable over the accordion fold resilient bladder member with a number of securing assemblies; the snap-open bladder cover assembly including a water-tight sealable pocket having a rigid, open-topped, card holding structure provided therein for holding credit cards, driver's licenses, etc, an attachment loop for attaching water proof pagers, telephones, etc., a sealable pocket having a fastener securable closing flap, and a faster securable inflation tube access flap provided therethrough that includes a grasping tab extending from a side edge thereof.

Accordingly, a water sport belt is provided. The water sport belt includes an accordion fold resilient bladder member, a snap-open bladder cover assembly, and a two-part fastener assembly; the two-part fastener assembly including a first fastener portion secured to a first bladder end and a first cover assembly end and a second fastener portion secured to a second bladder end and a second cover assembly end; the accordion fold resilient bladder member being constructed from a resilient air impermeable material to have a number of accordion folds to allow for easy inflation through a flexible inflation tube having a one-way air inlet valve provided therein such that air blown into the accordion fold resilient bladder member through the flexible inflation tube is trapped therein; the snap-open bladder cover assembly having a cover member back side secured to a bladder member backside of the accordion fold resilient bladder member and a forward portion securable over the accordion fold resilient bladder member with a number of securing assemblies; the snap-open bladder cover assembly including a water-tight sealable pocket having a rigid, open-topped, card holding structure provided therein for holding credit cards, driver's licenses, etc, an attachment loop for attaching water proof pagers, telephones, etc., a sealable pocket having a fastener securable closing flap, and a faster securable inflation tube access flap provided therethrough that includes a grasping tab extending from a side edge thereof.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
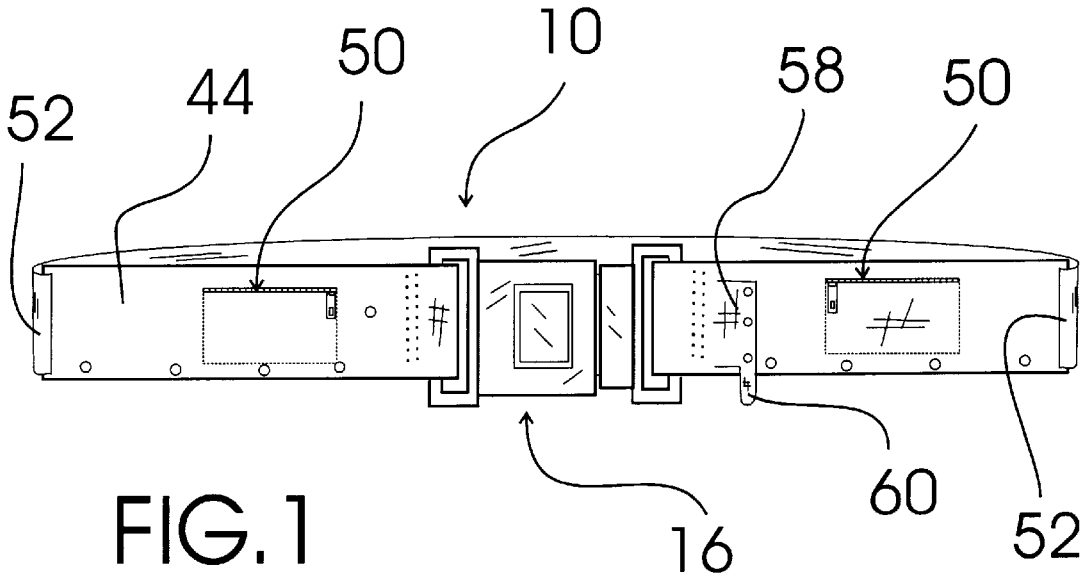
FIG. 1 is a front plan view of an exemplary embodiment of the water sport belt of the present invention showing the accordion fold resilient bladder member, the snap-open bladder cover assembly, and the two-part fastener assembly; the two-part fastener assembly including a first fastener portion secured to a first bladder end and a first cover assembly end and a second fastener portion secured to a second bladder end and a second cover assembly end; the accordion fold resilient bladder member being constructed from a resilient air impermeable material to have a number of accordion folds to allow for easy inflation through a flexible inflation tube having a one-way air inlet valve provided therein such that air blown into the accordion fold resilient bladder member through the flexible inflation tube is trapped therein; the snap-open bladder cover assembly having a cover member back side secured to a bladder member backside of the accordion fold resilient bladder member and a forward portion securable over the accordion fold resilient bladder member with a number of securing assemblies; the snap-open bladder cover assembly including a watertight sealable pocket having a rigid, open-topped, card holding structure provided therein for holding credit cards, driver's licenses, etc, an attachment loop for attaching water proof pagers, telephones, etc., a sealable pocket having a fastener securable closing flap, and a faster securable inflation tube access flap provided therethrough that includes a grasping tab extending from a side edge thereof.
Figure 2:
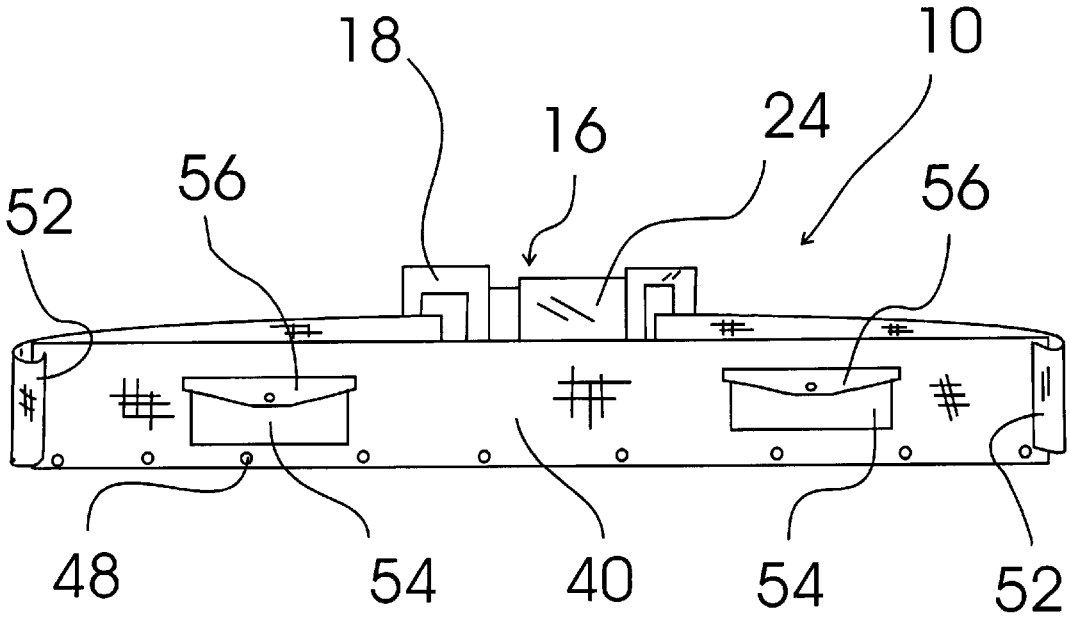
FIG. 2 is a plan view of the backside of the water sport belt of the present invention.
Figure 3:
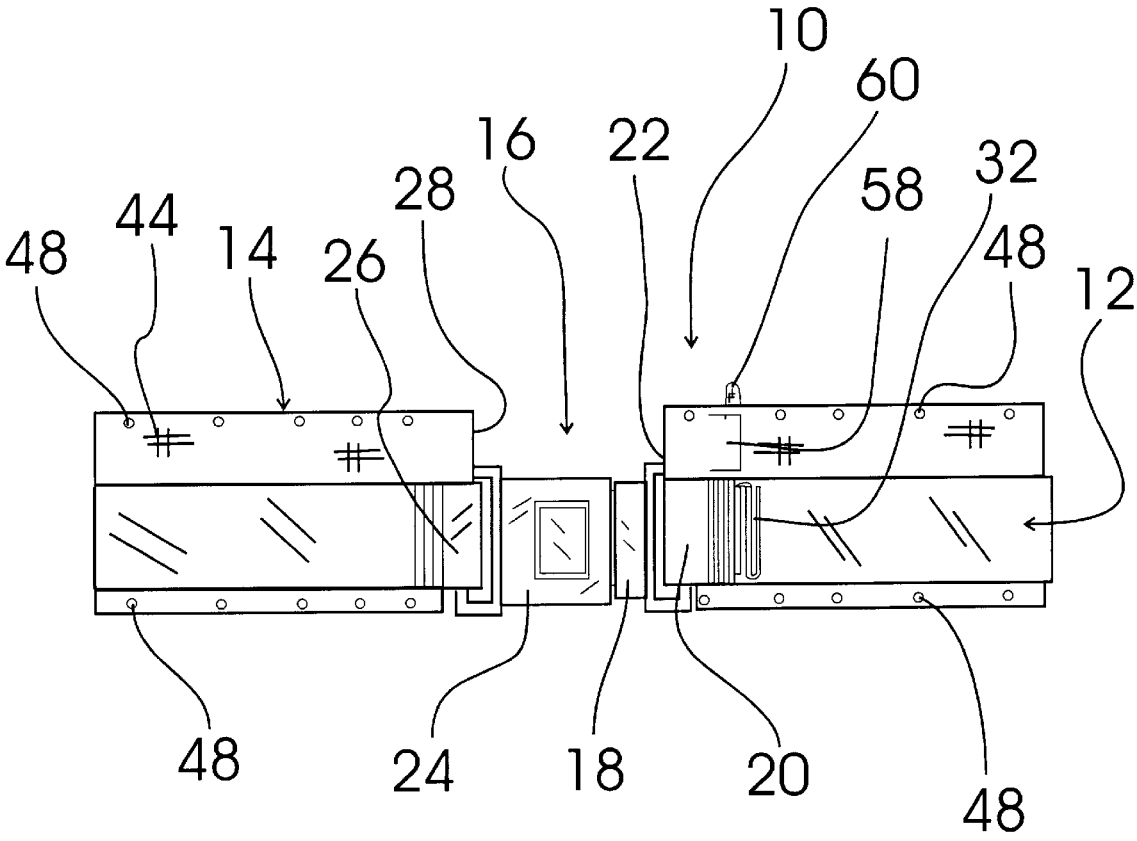
FIG. 3 is a front plan view of the water sport belt with the forward portion of the snap-open bladder cover assembly folded up to allow the accordion fold resilient bladder member to expand easily when inflated.
Figure 4:
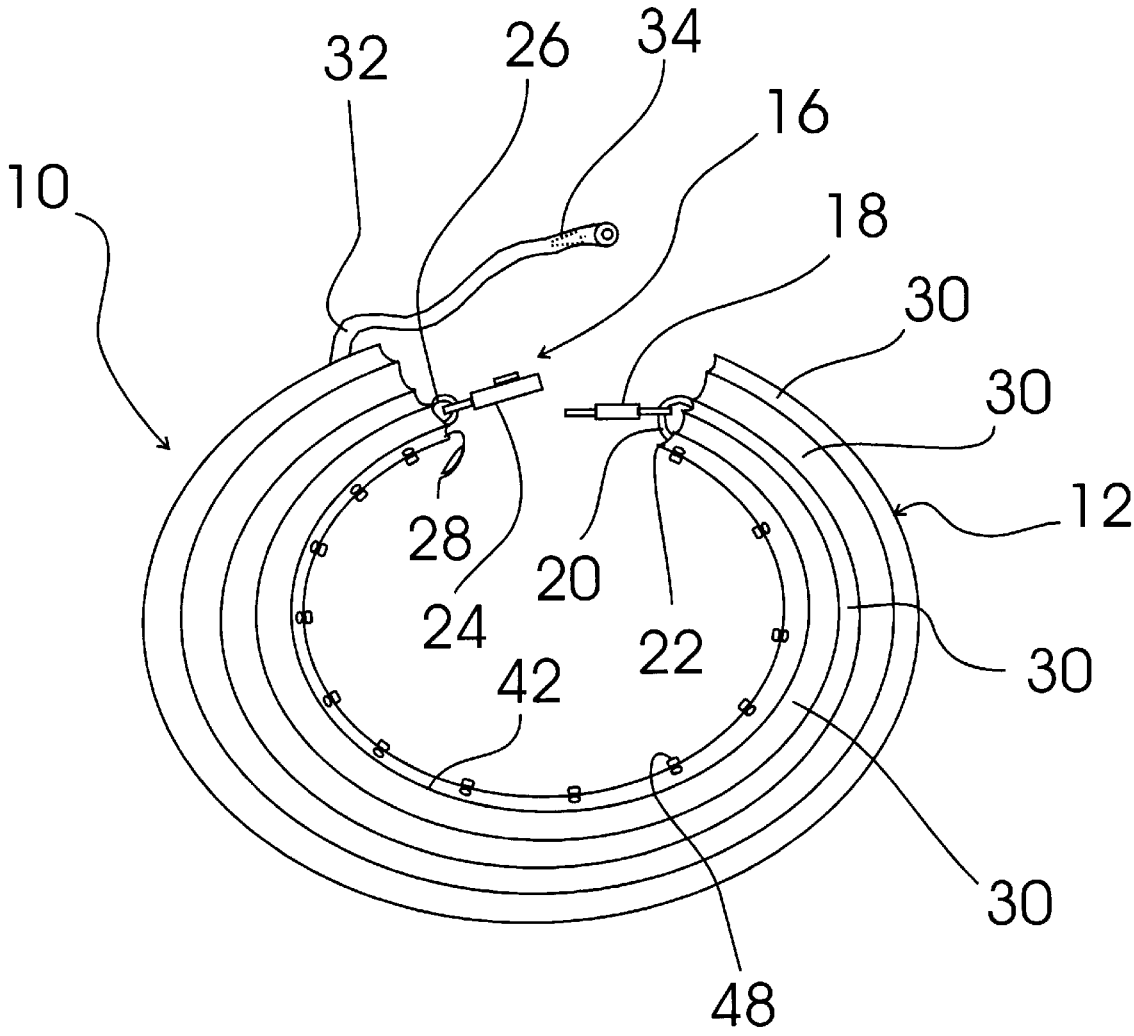
FIG. 4 is a bottom plan view showing the accordion fold resilient bladder member inflated.
Figure 5:
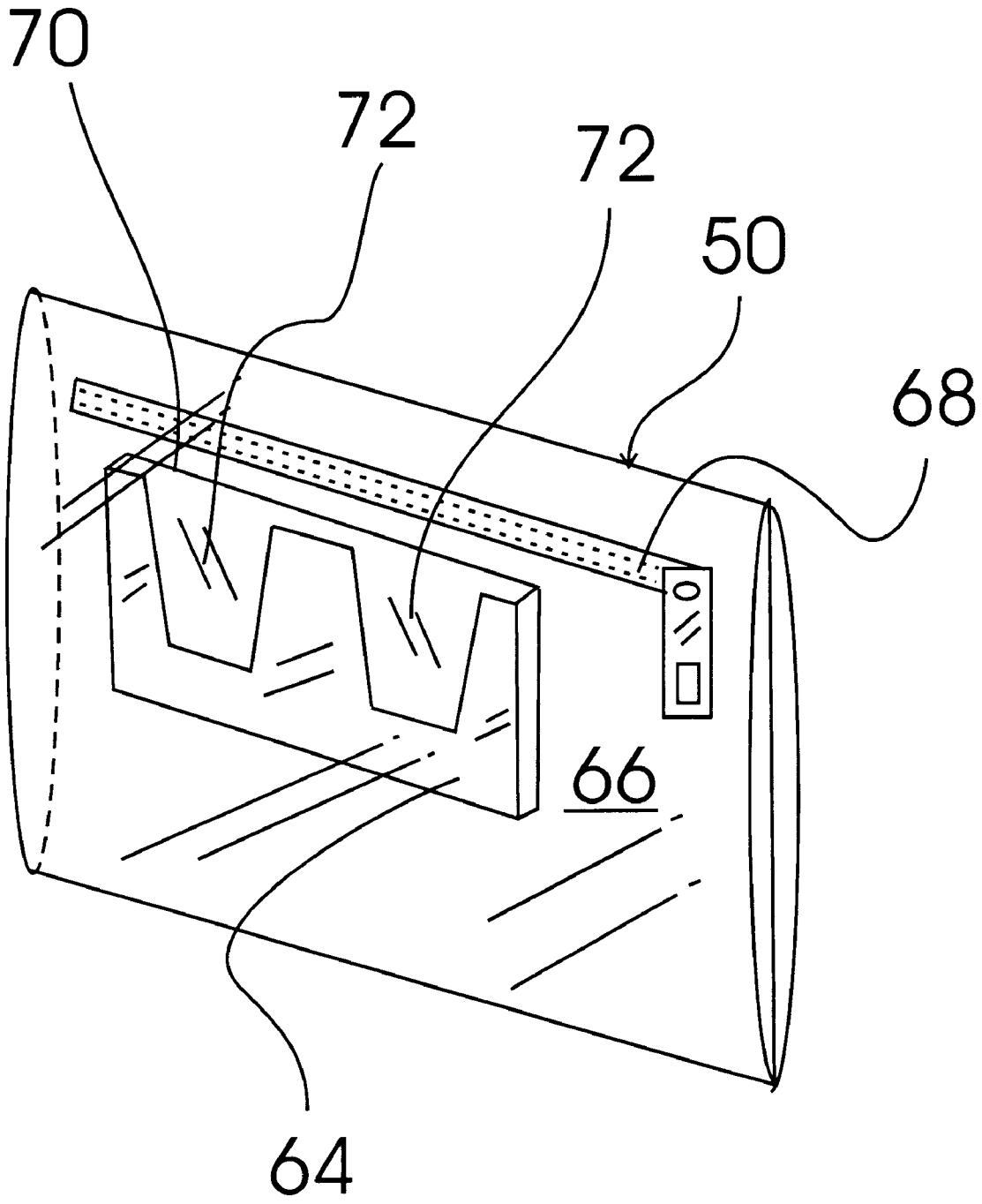
FIG. 5 is a perspective view of the water-tight sealable pocket in isolation showing the water-tight zipper and the rigid, open-topped, card holding structure provided within the water-tight compartment thereof.

FIGS. 1–5 show various aspects of an exemplary embodiment of the water sport belt of the present invention generally designated 10. Water sport belt 10 includes an accordion fold resilient bladder member, generally designated 12; a snap-open bladder cover assembly, generally designated 14; and a two-part buckle fastener assembly, generally designated 16.

Two-part buckle fastener assembly 16 including a first buckle fastener portion 18 secured to a first bladder end 20 and a first cover assembly end 22 and a second fastener portion 24 secured to a second bladder end 26 and a second cover assembly end 28.

Accordion fold resilient bladder member 12 is constructed from latex and has a number of accordion folds 30 to allow for easy inflation through a flexible inflation tube 32 having a one-way air inlet valve 34 provided therein such that air blown into the accordion fold resilient bladder member 12 through the flexible inflation tube 32 is trapped therein.

Snap-open bladder cover assembly 14 is constructed from spandex material and has a cover member back side 40 secured to a bladder member backside 42 of accordion fold resilient bladder member 12 by thermal welding and a forward portion 44 that is securable over accordion fold resilient bladder member 12 with a number of two-part snap securing assemblies 48. Snap-open bladder cover assembly 14 includes two identical water-tight sealable pockets, each generally designated 50, two securing loops 52 for attaching water proof pagers, telephones, etc., two conventional sealable pockets 54 each having a fastener securable closing flap 56, and a faster securable inflation tube access flap 58 provided therethrough that includes a grasping tab 60 extending from a side edge thereof. Each water-tight sealable pocket 50 is constructed from water impermeable plastic and has a rigid, molded plastic, open-topped, card holding structure 64 provided within a water-tight compartment 66 that is accessible through a water-tight zipper 68. Rigid, molded plastic, open-topped, card holding structure 64 has a card insertion slot 70 for inserting credit cards, driver's licenses, etc, to be held and two card retrieving notches 72 formed through one sidewall thereof to allow for easier removal of cards positioned therein.

It can be seen from the preceding description that a water sport belt.

It is noted that the embodiment of the water sport belt described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A water sport belt comprising:

an accordion fold resilient bladder member;

a snap-open bladder cover assembly; and a two-part fastener assembly;

said two-part fastener assembly including a first fastener portion secured to a first bladder end and a first cover assembly end and a second fastener portion secured to a second bladder end and a second cover assembly end;

said accordion fold resilient bladder member being constructed from a resilient air impermeable material to have a number of accordion folds to allow for easy inflation through a flexible inflation tube having a one-way air inlet valve provided therein such that air blown into said accordion fold resilient bladder member through said flexible inflation tube is trapped therein;

said snap-open bladder cover assembly having a cover member back side secured to a bladder member backside of said accordion fold resilient bladder member and a forward portion securable over said accordion fold resilient bladder member with a number of securing assemblies;

said snap-open bladder cover assembly including a water-tight sealable pocket having a rigid, open-topped, card holding structure provided therein, an attachment loop, a sealable pocket having a fastener securable closing flap, and a faster securable inflation tube access flap provided therethrough that includes a grasping tab extending from a side edge thereof.

* * * * *